US006002311A

United States Patent [19]

Wey et al.

[11] Patent Number: 6,002,311

[45] Date of Patent: Dec. 14, 1999

[54] DIELECTRIC TM MODE RESONATOR FOR RF FILTERS

[75] Inventors: Chia-Sam Wey, Arlington; Daniel Lee Iiams, Fort Worth, both of Tex.

[73] Assignee: Allgon AB, Akersberga, Sweden

[21] Appl. No.: 08/956,786

[22] Filed: Oct. 23, 1997

[51] Int. Cl.[6] ..... H01P 7/10

[52] U.S. Cl. ..... 333/219.1; 333/202

[58] Field of Search ..... 333/202, 219.1, 333/208, 235, 206

[56] References Cited

U.S. PATENT DOCUMENTS

| | | | |
|---|---|---|---|
| 4,028,652 | 6/1977 | Wakino et al. | 222/235 X |
| 4,477,788 | 10/1984 | Collinet et al. | 333/202 X |
| 4,521,746 | 6/1985 | Hwan et al. | 333/219.1 X |
| 4,613,838 | 9/1986 | Wada et al. | 333/232 |
| 4,626,809 | 12/1986 | Mizumura et al. | 333/202 |
| 4,963,841 | 10/1990 | Sparagna | 333/202 |
| 5,008,640 | 4/1991 | Accatino et al. | 333/219.1 |
| 5,027,090 | 6/1991 | Gueble et al. | 333/219.1 X |
| 5,097,238 | 3/1992 | Sato et al. | 333/219.1 |
| 5,140,285 | 8/1992 | Cohen | 331/96 |
| 5,612,655 | 3/1997 | Stronks et al. | 333/202 |
| 5,714,920 | 2/1998 | Ivanov et al. | 333/219.1 |

*Primary Examiner*—Seungsook Ham
*Attorney, Agent, or Firm*—Jacobson, Price, Holman & Stern, PLLC

[57] ABSTRACT

A TM mode dielectric resonator and a filter comprising such a resonator. The resonator includes metallic walls defining a cavity. A dielectric resonator body is accommodated within the cavity. An end surface of the dielectric resonator body is located in the vicinity of one cavity wall, so as to provide a spacing between said end surface and said cavity wall, at least in a region corresponding to a portion of said end surface. The spacing can be obtained by washers, arranged between the dielectric resonator body and said cavity wall. It can also be obtained by means of a recess in said cavity wall, one or more protrusions on said cavity wall, or a metallic or dielectric ring arranged between the dielectric resonator body and said cavity wall.

55 Claims, 5 Drawing Sheets

DIELECTRIC TM MODE RESONATOR FOR RF FILTERS

FIELD OF THE INVENTION

The invention relates to a dielectric resonator, and in particular to a TM mode dielectric resonator, including a resonator cavity in an electrically conductive housing and a dielectric resonator body, arranged in the resonator cavity. The invention also relates to a filter including one or more TM mode dielectric resonators.

BACKGROUND OF THE INVENTION

Applications of dielectric resonators in filter design have become more and more popular due to impressive advantages, such as small size, low weight, low loss (high Q), and common commercial availability. Dielectric resonators employed in filters could be utilized in a variety of modes, such as TE, TM, and HEM (hybrid electromagnetic) modes. Filters using resonators employing dual hybrid mode exhibit a symmetric bandpass response. Such resonators are mainly used in satellite communications. However, in applications where an asymmetric bandpass response is desired, such as mobile telephone communication, hybrid mode resonators are difficult to implement. Multi mode resonators having specific geometric forms are often complicated to manufacture. Due to drawbacks with hybrid dual mode and the low Q in conventional TM mode structure, the $TE_{010}$ mode have been extensively used in most of the high Q dielectrically loaded filters.

Accordingly, TE mode dielectric resonators are frequently used in mobile telephone communication systems. Because a $TE_{010}$ mode dielectric resonator body needs to be placed symmetrically in the center of the cavity, in order to obtain highest possible Q, a temperature stable and low loss mount to support the resonator is required. The selection of material and design of this support is critical to the performance of the filter and becomes a significant feature in the manufacture of the product. A dielectric resonator with such a support is disclosed in U.S. Pat. No. 5 612 655.

Tuning of the resonance frequency is provided by a tuning screw extending through the top cover. Because of strong magnetic field intensity in the center, a big metallic disk is typically soldered to the end of the screw. Due to limited tuning range, and following the demand for center symmetric mounting, the required coarse frequency modification of the resonator is mostly done by reducing the radius dimension by grinding. The above operations are costly and time consuming in the manufacture of the resonator.

A resonator of this kind is disclosed in U.S. Pat. No. 4 963 841. In this resonator the support has been replaced by a substrate in order to decrease vibration sensitivity. Through the selection of a substrate having a dielectric constant substantially greater than that of air, the dielectric resonator can be bonded to tho substrate, which in turn is bonded to a surface of the cavity, whereas the resonator is electrically centered in the cavity.

In filter application, coupling between $TE_{010}$ mode cavities is provided through an iris, and the adjustment is accomplished by a coupling adjusting means (a screw, wire or the like) placed tangential to the electric field. In this case (TE mode), a coupling adjusting means extends horizontally in the plane of the iris, which is difficult to implement and makes it difficult to access. When implementing a TE mode broadband filter, problems will arise with the adjacent TM mode since this mode couples strongly via the used apertures. This can easily lead to spurious response with adjacent TM modes.

Furthermore, due to the fact that the material of the support is d dielectric material, it is very poor in conducting heat. Thus, in high power applications, the temperature of the dielectric resonator can be very high, which may cause serious problems.

In conventional TM mode design, a dielectric resonator is placed on a substrate. The substrate can be placed on the base of a cavity. This offers significant size reduction, but poor unloaded Q ($Q_u$) compared to $TE_{010}$ mode ($Q_u$=5000 for $TM_{010}$ and $Q_u$=13000 for $TE_{010}$ at 1,9 GHz and $\epsilon$=30 to 40).

However, in filter applications, the use of TM mode resonators is preferable for a number of reasons, such as good coupling between TM modes through apertures, easy tuning and a good spurious response (attenuation of unwanted modes). For example, the coupling adjusting means, discussed above in connection with TE mode filters, can in TM mode filters be axially mounted, which is easily made in the lid of the filter unit.

U.S. Pat. No. 4 613 838 discloses a dielectric resonator employing a TM mode. It includes a cavity resonator and a columnar inner dielectric member accommodated within the cavity. The dielectric member is in contact at its both ends with inner electrode surfaces of the cavity. This document is regarded to disclose the prior art closest to the invention, since a dielectric resonator employing a TM mode is disclosed.

SUMMARY OF THE INVENTION

It is an object of the invention to provide a resonator, which has good coupling properties and a relatively high Q.

It is also an object of the invention to provide a resonator, which is easy to tune, without need of tuning disks and complicated radius grinding.

It is also an object of the invention to provide a resonator, which provides for a cost effective and easy manufacturing and prototyping.

It is also an object of the invention to provide a resonator, which provides for a good spurious response, i. e. unwanted modes are attenuated.

It is also an object of the invention to provide a resonator, which is robust and has a reliable mechanical design.

These and other objects are attained by TM mode dielectric resonator, having an electrically conductive housing which defines a resonator cavity therein, the cavity having first and second oppositely located cavity walls, a dielectric resonator body, arranged in the resonator cavity, in vicinity of the second cavity wall, and having a first and a second end surface, and said second end surface facing said second cavity wall, wherein said dielectric resonator body is arranged so as to provide a spacing between said second end surface and said second cavity wall, at least in a (first) region corresponding to a portion of said second end surface.

A further object of the invention is to provide a TM mode resonator, comprising a cavity and a dielectric resonator therein, in which heat is conducted away from the dielectric resonator body, in order to attain a resonator, which is temperature stable, efficient and maintains its high Q. This is especially important in high power applications, such as in for example transmitter filters.

This is attained by the arrangement of region(s) in which the dielectric resonator is in contact with a cavity wall.

It is also an object of the invention to provide a TM mode resonator, comprising a cavity and a dielectric resonator therein, having improved field distribution in the area (region) between the edge of the dielectric resonator and the adjacent cavity wall at which the dielectric resonator is fastened, and thereby achieve an even higher Q.

This is attained by the arrangement of a flange on the dielectric resonator.

DESCRIPTION OF PREFERRED EMBODIMENTS

Figure 1:
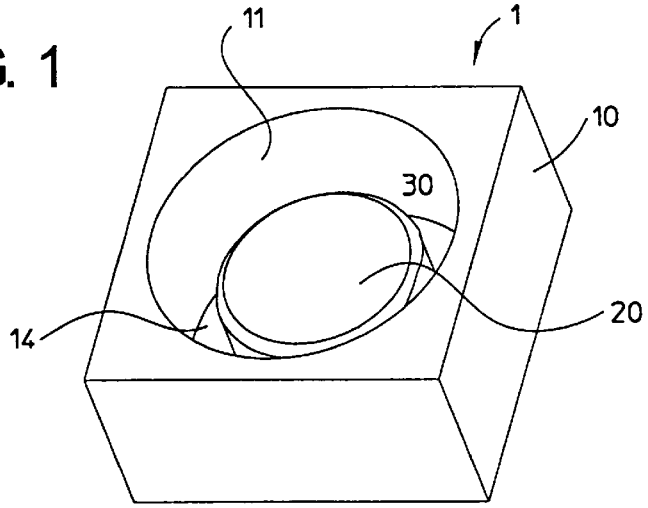
FIG. 1 is a perspective view of a TM mode dielectric resonator according to the invention.

It is to be noted that like or corresponding parts are designated by like reference numerals throughout the drawings.

FIG. 1 is a perspective view of a TM mode dielectric resonator 1 according to the invention. It comprises a housing 10 including a first wall (12 not shown) serving as a lid, a second wall 14 at the bottom, and a cylindrical side wall 11. However, the side wall 11 can be divided into planar wall sections, for forming a cavity of, for example, box like shape. The walls 11, 12, 14 are metallic and between them a cavity 30 is formed.

A dielectric resonator body 20 is accommodated in the cavity 30. The dielectric resonator body 20 shown is a cylindrical body or a so called puck. Other shapes are possible, for example quadratic or rectangular shapes, as seen from above. Dielectric resonator bodies are today made of a dielectric ceramic material with a dielectric constant typically in the range 20–44, or even higher, then with a higher loss. As seen in FIG. 1, the dielectric resonator body is placed in the center of the cavity in the vicinity of the second wall 14 of the cavity. The central placement is preferred, but other placements are also possible.

What is said about the resonator i in FIG. 1 is common for the embodiments below. In the following, special configurations of the dielectric resonator body 20 and the second wall 14, as well as their mutual arrangement and coaction, will be described in detail.

Figure 2:
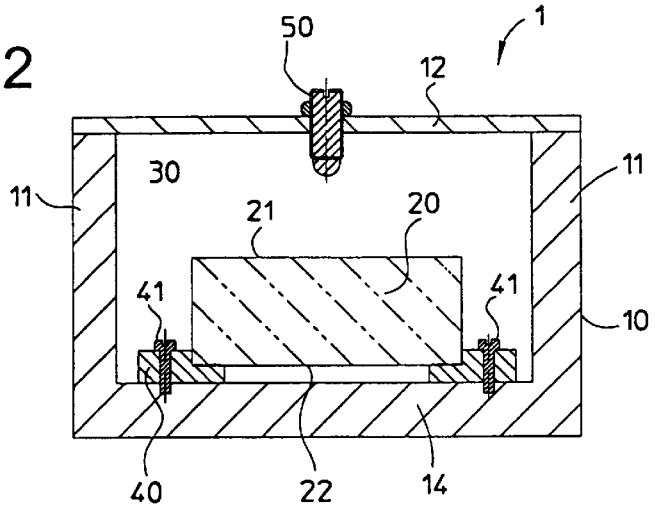
FIG. 2 is a sectional view of a first embodiment of a TM mode dielectric resonator according to the invention.

Referring to FIG. 2, a first embodiment of a TM mode dielectric resonator according to the invention is shown in a side view. The cavity 30 is formed by a first wall 12, a second wall 14 and a cylindrical side wall 11. The first wall 12 is a separate lied, which may be removed so as to permit access to the cavity.

The dielectric resonator body 20 is placed close to the second wall 14 but with a spacing therebetween. This is achieved by attaching a ring 40 to the second wall 14. The ring 40 is made of a dielectric material with a low dielectric constant, substantially lower than that of the dielectric resonator body 20. A preferred material is Q 200.5®, which is a crosslinked polystyrene from Polypenco. Further, the ring 40 is provided with an annular shoulder on its inside for receiving the dielectric resonator body 20, which can be fastened to the ring 40 by an adhesive or by clamping action. The ring 40 is attached to the second wall 14 e.g. by means of screws 41 (as shown), or an adhesive. When using screws 41, dielectric screws give a higher Q than metallic screws.

By the arrangement of the spacing, the currents induced in the second wall will decrease and thereby a higher Q is attained.

The dielectric resonator body can be coarsely adjusted in frequency or tuned by grinding a first end surface 21 thereof. This is a simple and cost effective operation which is very advantageous, especially in prototyping. Moreover, the resonator can be tuned by a tuning screw 50, arranged in the first wall 12 and extending through the wall. This is one of the advantages employing a TM mode, viz. the tuning can easily be made by a simple tuning screw, without the need of a tuning disc.

Figure 3:
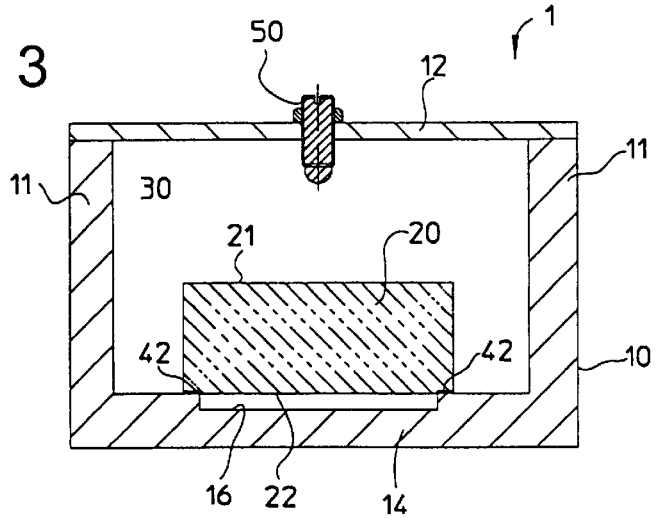
FIG. 3 is a sectional view of a second embodiment of a TM mode dicloctric resonator according to the invention.

FIG. 3 shows a second embodiment, wherein the second wall 14 and the mounting of the dielectric resonator body 20 are different. The second wall 14 is provided with a recess 16. This recess is centrally located in a region of the second wall 14 corresponding to a portion of an adjacent second end surface 22 of the dielectric resonator body 20. The recess has a configuration, in a plane parallel to the second wall 14, which is smaller than the configuration of the dielectric resonator body in a plane parallel to the second wall 14. Said configurations are preferably uniform, even if different shapes are possible. The depth of the recess 16 is in the millimeter range, i.e. 0,5–15 mm, preferably 0,5–10 mm, in particular about 2–3 mm. The depth can alternatively depend on the size of the dielectric resonator body 20, and preferably be 1–20% of the height (distance between the two end surfaces 21, 22) or diameter of the dielectric resonator body 20. The depth can be the same over the whole recess or can vary over the recess.

The dielectric resonator body 20 is in contact with the second wall 14 in an annular second region 42 around the recess 16. In this second region 42, the dielectric resonator body 20 is secured to the second wall 14 by an adhesive, or by soldering after metallizing of the dielectric resonator body 20 in the second region 42. Due to this contact, heat will be conducted away from the dielectric resonator body 20. This provides for a good temperature stability and a high Q even at high power.

Figure 4:
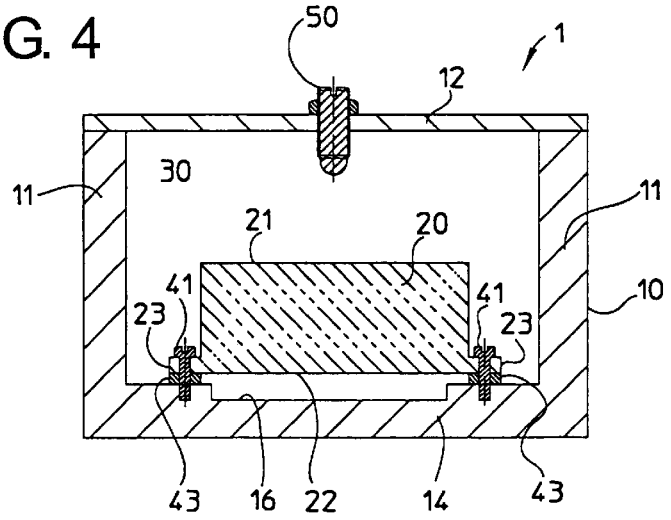
FIG. 4 is a sectional view of a third embodiment of a TM mode dielectric resonator according to the invention.

FIG. 4 shows a third embodiment of the invention, wherein the dielectric resonator body 20 is provided with a relatively thin flange 23, arranged so that the surface of the flange facing the second wall 14 is in the same plane as the second end surface 22 of the dielectric resonator body 20. Preferably the flange is made of the same material as the dielectric resonator body 20, so as to form an integral part thereof. Preferably the flange 23 extends all the way around the dielectric resonator body 20.

One advantage with the flange being thin is that the electric field in the dielectric resonator body 20, will penetrate out into the flange, only to a low degree. Hereby, a better field distribution in the area around the flange is achieved, as well as a higher Q value for the resonator. However, the thickness of the flange 23 may vary widely, but it is preferably about 4 mm. It must be thick enough to provide for a rugged and resistant mounting of the dielectric resonator body 20.

As shown, the flange 23 also has an important task in the fastening of the dielectric resonator body 20. The flange is provided with holes through which screws 41, screwed in to the second wall 14, extend. Between the flange and the second wall 14 preferably dielectric washers 43 are arranged around the screws 41.

The recess is shown to have a configuration, in a plane parallel to the second wall 14, which is smaller than the configuration of the dielectric resonator body in a plane parallel to the second wall 14. However the configurations may alternatively be of essentially the same size. Said configurations are preferably uniform, even if different shapes are possible. The depth of the recess 16 is in the millimeter range, or as in the previous embodiment.

Figure 5:
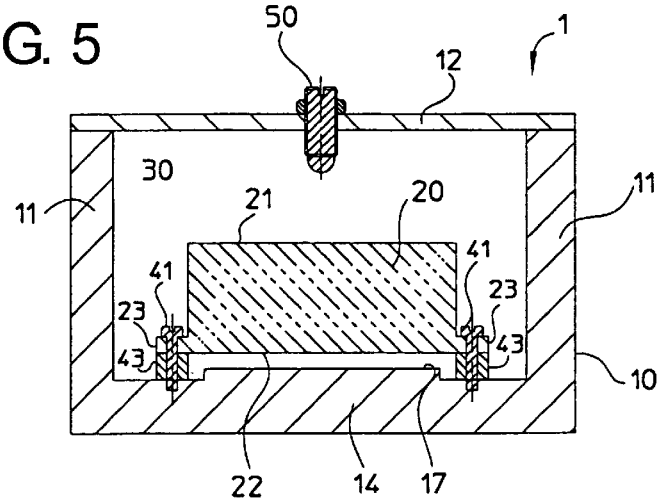
FIG. 5 is a sectional view of a fourth embodiment of a TM mode dielectric resonator according to the invention.

FIG. 5 shows a fourth embodiment of the invention, wherein the second wall 14 is provided with a protrusion 17 in a central portion of a first region which corresponds to a portion of the adjacent second end surface of the dielectric resonator body 20.

Figure 6:
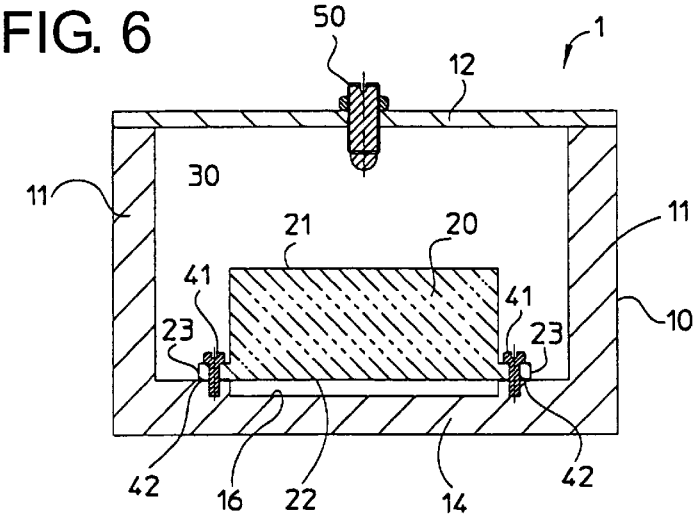
FIG. 6 is a sectional view of a fifth embodiment of a TM mode dielectric resonator according to the invention.

FIG. 6 shows, in a sectional view a fifth embodiment, which differs from the third embodiment of FIG. 4 as regards the fastening of the dielectric resonator body 20 to the second wall 14, and possibly also as regards the configuration of the recess.

The dielectric resonator body 20 is attached to the second wall 14 so that the flange 23 is in contact with the second wall 14 in an annular second region 42 around the recess 16. As shown, the flange is provided with holes through which fastening screws 41 extend. Alternatively, the dielectric resonator body 20 can be attached to the second wall 14 with an adhesive, or by soldering after metallizing the flange in the second region 42. Due to this contact, heat will be conducted away from the dielectric resonator body 20. This provides for a good temperature stability and a high Q even at high power.

The recess has a configuration, in a plane parallel to the second wall 14, which is equal to the configuration of the dielectric resonator body in a plane parallel to the second wall 14 (and not including the flange). Said configurations preferably have the same size and shape, even if different sizes and shapes are possible, where for example one configuration is larger than the other. The depth of the recess 16 is in the millimeter range, i.e. 0,5–15 mm, preferably 0,5–10 mm, in particular about 2–3 mm. The depth can alternatively depend on the size of the dielectric resonator body 20, and preferably be 1–20% of the height (distance between the two end surfaces 21, 22) or diameter of the dielectric resonator body 20. The depth can be the same over the whole recess or vary.

Figure 7:
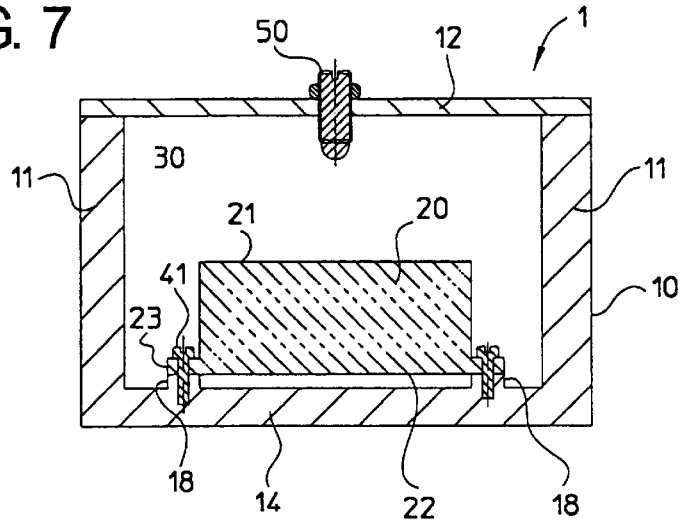
FIG. 7 is a sectional view of a sixth embodiment of a TM mode dielectric resonator according to the invention.

FIG. 7 shows a sixth embodiment of the invention, where the second wall 14 is formed with an annular protrusion 18 being in contact with the flange 23. The dielectric resonator body 20 can be fastened to the second wall 14 as in the fifth embodiment. Alternatively, the annular protrusion can be replaced by an annular metallic gasket or a metallic ring, e.g. of copper, which can act as a temperature compensator. The dielectric resonator body 20 and the ring or gasket can be fastened to the second wall 14 by screws through the flange and the ring or gasket, by an adhesive or by soldering after metallizing the flange surface, which is in contact with the ring or gasket. The space between the dielectric resonator body 20 and the second wall 14 preferably has the same dimensions as the recess in the fifth embodiment.

Alternatively, the annular protrusion 18 can be divided into segments or even a number of (preferably at least three) separate boss like protrusions, configured on the second wall 14.

Figure 8:
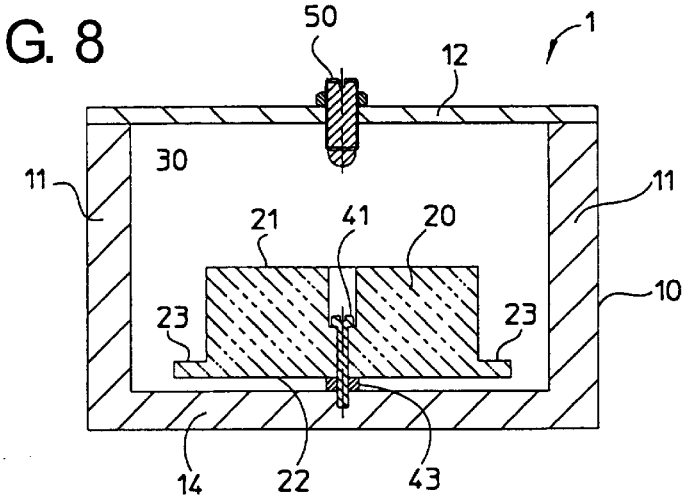
FIG. 8 is a sectional view of a seventh embodiment of a TM mode dielectric resonator according to the invention.

FIG. 8 shows a seventh embodiment of the invention, wherein the dielectric resonator body 20 is secured by means of a central dielectric screw 41. Between the dielectric resonator body 20 and the second wall 14 a dielectric washer 43 is arranged around the screw 41. The dielectric resonator body 20 is shown to have a flange, but in this embodiment the flange could be left out.

Alternatively, this method of fastening the dielectric resonator body 20 to the second wall 14, by means of a central dielectric screw 41 can be used in all the previous and following embodiments. E. g. in the embodiments shown in FIGS. 2, 3, 6, 7, 9 and 10 a central screw can he used, without any washer between the dielectric resonator body 20 and the second wall 14. In the embodiments shown in FIGS. 4 and 5 a washer would be necessary in order to obtain the desired spacing.

Figure 9:
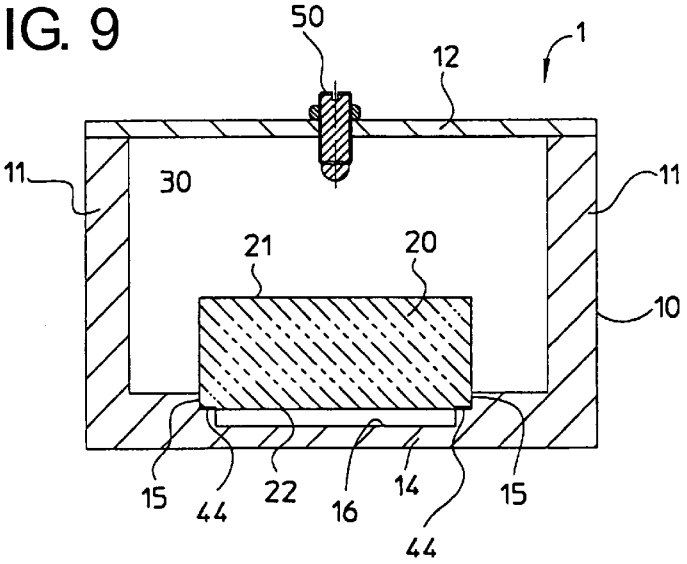
FIG. 9 is a variation of the second embodiment of FIG. 3.

FIG. 9 shows a variation of the second embodiment, shown in FIG. 3. The only difference is that a groove or recessed shoulder is arranged around the recess 16, in which groove or shoulder the dielectric resonator body 20 is secured to the second wall 14 with a snug fit, possibly with the aid of an adhesive. It may also be secured as in the second embodiment, where all the contact surfaces of the dielectric resonator body 20 and the groove or recessed shoulder could be provided with an adhesive or soldered after metallizing.

Figure 10:
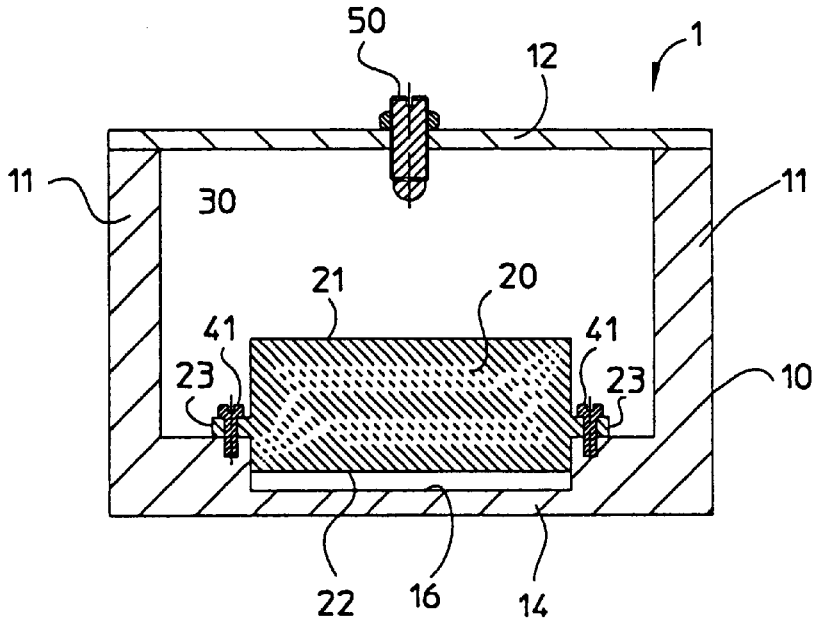
FIG. 10 is a variation of the fifth embodiment of FIG. 6.

FIG. 10 shows a variation of the fifth embodiment, shown in FIG. 6. The difference is that the flange is located between the first and second end surfaces of the dielectric resonator body 20, so that the dielectric resonator body 20 penetrates into the recess 16. The dielectric resonator body 20 is secured to the second wall 14 with a snug tit, possibly with the aid of an adhesive, or as in the fifth embodiment (FIG. 6).

By those two variations, a better contact between the dielectric resonator body 20 and the second wall 14 is attained. This improves the heat conduction, especially where the ceramic and the metal materials make contact, which leads to a higher Q value in high power applications. It also improves the mechanical stability, especially in radial directions.

Figure 11:
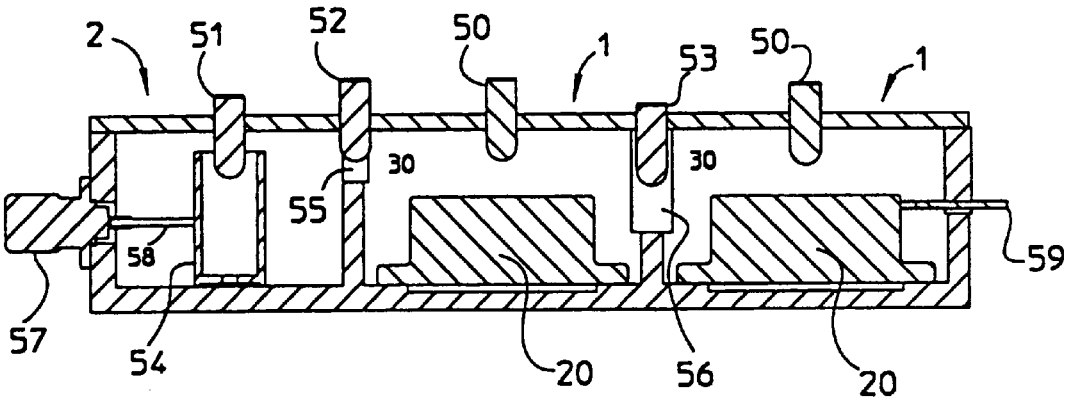
FIG. 11 is a sectional view of a filter according to the invention, including two TM mode dielectric resonators according to the invention.
Figure 12:
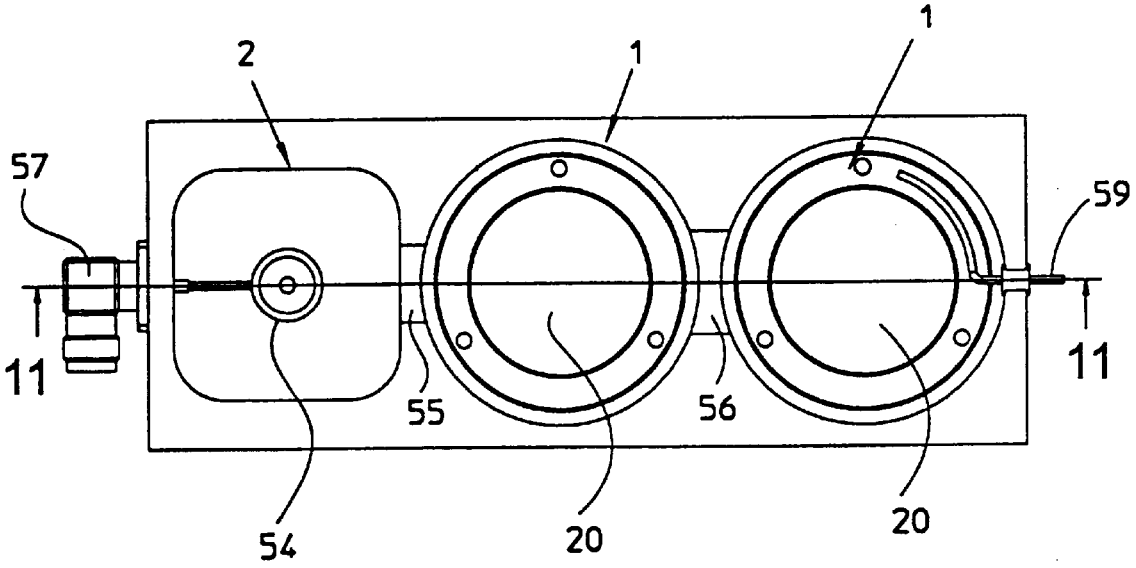
FIG. 12 is a top view of the filter of FIG. 11, wherein the top wall or lid is removed.

FIGS. 11 and 12 show a filter, including three coupled resonators 1, 2, whereof two resonators 1 are of a kind described above. The third resonator 2 is a rod-resonator (also called coaxial or re-entrent resonator), including a rod 54 and a tuning screw 51. The rod 54 is soldered to a connecting wire 58, which connects the rod to a coaxial connector 57, being an output from the filter (alternatively the input). The resonators are shown to be coupled in series, via coupling windows 55, 56, provided with coupling screws 52, 53 respectively. The resonator 1 to the right is capacitively coupled to a wire 59 which is an input to the filter (alternatively the output).

In a filter of this kind, the resonators couple strong to each other through the windows 55, 56, since the resonators 1, 2 have the same axial direction. As seen the tuning screws 50, 51 of the resonators 1, 2, as well as the coupling screws 52, 53 of the coupling windows 55, 56 all extend through the lid or top wall. This provides for an easy access to the screws.

In a filter of this kind, the advantages mentioned above and below, of the resonator according to the invention, are employed.

Figure 13:
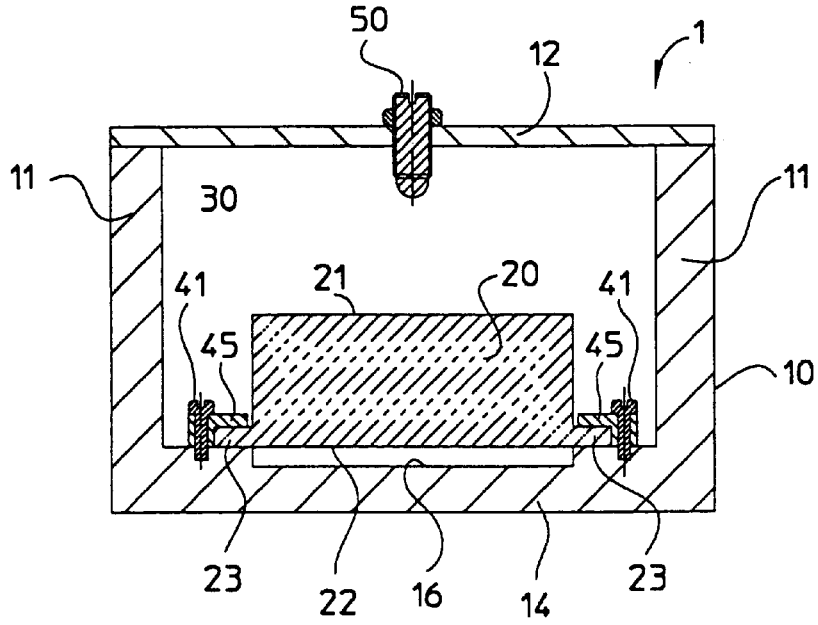
FIG. 13 is a sectional view similar to FIG. 6, showing a further embodiment of a fastening means according to the invention.

FIG. 13 shows a variation of the fifth embodiment (FIG. 6), where an alternative type of fastening means 45, is employed. Fastening means 45 are formed as a clamps 45 attached to the second wall 14 and grip the flange 23. A number of such clamps 45 can be arranged to grip the flange 23 around the dielectric resonator body 20, to secure a safe mounting of the same, and yet adversely effect the Q-value to a small extent.

In all embodiments where the second wall 14 has a recess, the recess causes a change of the resonance frequencies for the TM modes, whereas the resonance frequencies for HEM (hybrid) modes arc hardly influenced at all. By a grinding of the top (the first end surface) of the dielectric resonator body 20, the resonance frequencies for both the TM and HEM modes change to almost the same extent. Those two methods for moving the resonance frequencies can be used in cooperation to separate the resonance frequencies for the HEM modes. When the resonance frequencies are separated for the same mode the magnitude will be attenuated. This is especially advantageous in filters where a plurality of resonators are used. In this case unwanted modes can easily be attenuated.

In the cases where there is an annular contact surface (or volume) between the dielectric resonator body 20 and the second wall 14, a shortening or attenuation of the lowest TE mode is achieved.

A dielectric resonator according to the invention is primarily intended for use within RF frequencies, especially in the microwave range. It is very advantageous in the $TM_{010}$ mode and variations thereof.

Although the invention has been described in conjunction with a number of preferred embodiments, it is to be understood that various modifications may still be made without departing from the spirit and scope of the invention, as defined by the appended claims. For example the depth of the recess or the said spacing can vary, depending on the specific use. Also the filter, including different resonators, can be varied widely.

We claim:

1. A TM mode dielectric resonator, comprising:

an electrically conductive housing which defines a resonator cavity therein, the cavity having first and second oppositely located cavity walls, a dielectric resonator body, arranged in the resonator cavity, in vicinity of the second cavity wall, and having a first and a second end surface, said second end surface facing said second cavity wall, characterized in that said dielectric resonator body is arranged so as to provide a spacing between said second end surface and said second cavity wall, at least in a first region corresponding to a portion of said second end surface, the second cavity wall is provided with a recess in said first region, the dielectric resonator body is in contact with the second cavity wall in a second region around the recess, said dielectric resonator body is provided with a dielectric flange between said first and second end surfaces, the flange is provided with holes for fasteners, fasteners are arranged through said holes for fastening the dielectric resonator body to the second cavity wall, and washers are arranged around the fasteners between the dielectric resonator body and the second cavity wall.

2. The TM mode dielectric resonator according to claim 1, wherein the flange is an integral part of the dielectric resonator body, and made of the same material.

3. The TM mode dielectric resonator according to claim 1, wherein said dielectric resonator body is provided with the flange at its second end surface so that a surface of the flange forms an extension of the second end surface.

4. The TM mode dielectric resonator according to claim 1, wherein the dielectric resonator body has a diameter in a plane parallel to the second cavity wall, and the spacing between the second cavity wall and the second end surface of the dielectric resonator body is 1–20% of said diameter.

5. The TM mode dielectric resonator according to claim 1, wherein the depth of the recess is 1–20% of a distance between the first and second end surfaces.

6. The TM mode dielectric resonator according to claim 1, wherein said flange is in contact with the second cavity wall.

7. The TM mode dielectric resonator according to claim 1, wherein the recess and the dielectric resonator body have cross sections of the same shape in planes parallel to the second cavity wall.

8. The TM mode dielectric resonator according to claim 7, wherein the recess and the dielectric resonator body have cross sections of essentially the same size in planes parallel to the second cavity wall.

9. The TM mode dielectric resonator according to claim 1, wherein the spacing between the second end surface of the dielectric resonator body and the second cavity wall is constant.

10. The TM mode dielectric resonator according to claim 1, wherein the spacing between the second end surface of the dielectric resonator body and the second cavity wall is not constant.

11. The TM mode dielectric resonator according to claim 1, wherein the depth of the recess is in 0.5–15 mm.

12. The TM mode dielectric resonator of claim 1, the TM mode dielectric resonator coupled with one or more resonator to form a TM dielectric filter.

13. A TM mode dielectric resonator, comprising:

an electrically conductive housing which defines a resonator cavity therein, the cavity having first and second oppositely located cavity walls, a dielectric resonator body, arranged in the resonator cavity, in vicinity of the second cavity wall, and having a first and a second end surface, said second end surface facing said second cavity wall, characterized in that said dielectric resonator body is arranged so as to provide a spacing between said second end surface and said second cavity wall, at least in a first region corresponding to a portion of said second end surface, said dielectric resonator body is provided with a dielectric flange between said first and second end surfaces, and the spacing between the second cavity wall and the second end surface of the dielectric resonator body is 1–20% of a distance between the first and second end surfaces and substantially uniform.

14. The TM mode dielectric resonator according to claim 13, wherein the flange is an integral part of the dielectric resonator body, and made of the same material.

15. The TM mode dielectric resonator according to claim 13, wherein said dielectric resonator body is provided with the flange at said second end surface so that a surface of the flange forms an extension of the second end surface.

16. The TM mode dielectric resonator according to claim 13, wherein the flange is provided with holes for fasteners.

17. The TM mode dielectric resonator according to claim 16, wherein fasteners are arranged through said holes for fastening the dielectric resonator body to the second cavity wall, and washers are arranged around said fasteners between the dielectric resonator body and the second cavity wall, which washers provide for said spacing.

18. The TM mode dielectric resonator according to claim 13, further comprising clamps disposed in the second cavity wall to fasten the dielectric resonator by gripping the flange.

19. The TM mode dielectric resonator according to claim 13, wherein the second cavity wall is provided with at least one protrusion in at least a portion of said first region.

20. The TM mode dielectric resonator according to claim 13, wherein the second cavity wall is provided with a recess in said first region.

21. The TM mode dielectric resonator according to claim 13, wherein the second cavity wall is provided with at least one unitary protrusion being in contact with a portion of the second end surface of the dielectric resonator body.

22. The TM mode dielectric resonator according to claim 21, wherein said at least one protrusion comprises a boss having a cylindrical shape.

23. The TM mode dielectric resonator according to claim 21, wherein said at least one protrusion is annular.

24. The TM mode dielectric resonator according to claim 21, wherein said at least one protrusion is in contact with the dielectric flange, the flange is an integral part of the dielectric resonator body, and made of the same material.

25. A TM mode dielectric resonator according to claim 1, wherein a dielectric screw is arranged through at least a portion of the dielectric resonator body, in the center thereof, and into the second cavity wall.

26. A TM mode dielectric filter, comprising two or more coupled resonators, whereof at least one of the coupled resonators is a TM mode dielectric resonator according to claim 13.

27. The TM mode dielectric resonator according to claim 20, wherein the dielectric resonator body is in contact with the second cavity wall in a second region around the recess.

28. A TM mode dielectric resonator, comprising:

an electrically conductive housing which defines a resonator cavity therein, the cavity having first and second oppositely located cavity walls, a dielectric resonator body, arranged in the resonator cavity, in vicinity of the second cavity wall, and having a first and a second end surface, said second end surface facing said second cavity wall, characterized in that said dielectric resonator body is arranged so as to provide a spacing between said second end surface and said second cavity wall, said second cavity wall having a first region corresponding to a central portion of said second end surface defined by said spacing, and said dielectric resonator body is fastened to the second cavity wall in a second region surrounding the first region.

29. The TM mode dielectric resonator according to claim 28, wherein the second cavity wall is provided with a recess in said first region.

30. The TM mode dielectric resonator according to claim 28, wherein the dielectric resonator body is in contact with the second cavity wall in the second region.

31. The TM mode dielectric resonator according to claim 28, wherein said dielectric resonator body is provided with a dielectric flange between said first and second end surfaces.

32. The TM mode dielectric resonator according to claims 31, wherein the flange is an integral part of the dielectric resonator body, and made of the same material.

33. The TM mode dielectric resonator according to claim 31, wherein said dielectric resonator body is provided with the flange at said second end surface so that a surface of the flange forms an extension of the second end surface.

34. The TM mode dielectric resonator according to claim 30, wherein the dielectric resonator body is metallized at the second region, and the dielectric resonator body is soldered to the second cavity wall.

35. The TM mode dielectric resonator according to claim 30, wherein the dielectric resonator body is provided with an adhesive at the second region, and the dielectric resonator body is adhered to the second cavity wall.

36. The TM mode dielectric resonator according to claim 31, wherein said flange is in contact with the second cavity wall.

37. The TM mode dielectric resonator according to claim 29, wherein the recess and the dielectric resonator body have conformal cross sections.

38. The TM mode dielectric resonator according to claim 37, wherein the recess and the dielectric resonator body have cross sections of the same size in planes parallel to the second cavity wall.

39. The TM mode dielectric resonator according to claim 28, wherein the spacing between the second end surface of the dielectric resonator body and the second cavity wall is constant.

40. The TM mode dielectric resonator according to claim 28, wherein the spacing between the second end surface of the dielectric resonator body and the second cavity wall is not constant.

41. The TM mode dielectric resonator according to claim 28, wherein the spacing between the second cavity wall and the second end surface of the dielectric resonator body is 1–20% of a distance between the first and second end surfaces.

42. The TM mode dielectric resonator according to claim 36, wherein a surface of the flange in contact with the second wall is metallized, and the flange is soldered to the second cavity wall.

43. The TM mode dielectric resonator according to claim 36, wherein a surface of the flange in contact with the second wall is provided with an adhesive, and the flange is adhered to the second cavity wall.

44. The TM mode dielectric resonator according to claim 31, wherein the flange is provided with holes for fasteners.

45. The TM mode dielectric resonator according to claim 44, wherein fasteners are arranged through said holes for fastening the dielectric resonator body to the second cavity wall, and washers are arranged around said fasteners between the dielectric resonator body and the second cavity wall, which washers provide for said spacing.

46. The TM mode dielectric resonator according to claim 31, further comprising clamps disposed in the second cavity wall to fasten the dielectric resonator by gripping the flange.

47. The TM mode dielectric resonator according to claim 28, wherein the second cavity wall is provided with at least one protrusion in at least a portion of said first region.

48. The TM mode dielectric resonator according to claim 28, wherein the second cavity wall is provided with at least one unitary protrusion in contact with a portion of the second end surface of the dielectric resonator body.

49. The TM mode dielectric resonator according to claim 48, wherein said at least one protrusion is boss-shaped.

50. The TM mode dielectric resonator according to claim 48, wherein said at least one protrusion is annular.

51. The TM mode dielectric resonator according to claim 48, wherein said at least one protrusion is in contact with a dielectric flange provided between the first and second end surfaces of said dielectric resonator body, the flange is an integral part of the dielectric resonator body, and made of the same material.

52. The TM mode dielectric resonator according to claim 28, wherein the spacing between the second cavity wall and the second end surface of the dielectric resonator body is 0.5–15 mm.

53. The TM mode dielectric resonator according to claim 28, wherein the second cavity wall exhibits a third region surrounding the second region.

54. The TM mode dielectric resonator according to claim 28, wherein the dielectric resonator body has a diameter in a plane parallel to the second cavity wall, and the spacing between the second cavity wall and the second end surface of the dielectric resonator body is 1–20% of said diameter.

55. A TM mode dielectric filter, comprising two or more coupled resonators, whereof at least one of the coupled resonators is a TM mode dielectric resonator according to claim 28.

* * * * *